US010495428B1

(12) United States Patent
Patel

(10) Patent No.: US 10,495,428 B1
(45) Date of Patent: Dec. 3, 2019

(54) ELECTRONIC GAME TRACKING SYSTEM

(71) Applicant: Bhavik G. Patel, Elk Grove Village, IL (US)

(72) Inventor: Bhavik G. Patel, Elk Grove Village, IL (US)

( * ) Notice: Subject to any disclaimer, the term of this patent is extended or adjusted under 35 U.S.C. 154(b) by 0 days.

(21) Appl. No.: 15/822,828

(22) Filed: Nov. 27, 2017

Related U.S. Application Data

(63) Continuation-in-part of application No. 14/746,768, filed on Jun. 22, 2015, now Pat. No. 9,829,294, which is a continuation of application No. 13/374,672, filed on Jan. 6, 2012, now Pat. No. 9,062,947.

(51) Int. Cl.
*F42B 6/04* (2006.01)
*F42B 12/38* (2006.01)

(52) U.S. Cl.
CPC ..... *F42B 12/385* (2013.01); *F42B 6/04* (2013.01)

(58) Field of Classification Search
CPC ..... F42B 6/04; F42B 12/385
See application file for complete search history.

(56) References Cited

U.S. PATENT DOCUMENTS 3,790,948 A * 2/1974 Ratkovich ..... F42B 6/04 342/386
4,704,612 A * 11/1987 Boy ..... G01S 1/68 342/386
4,885,800 A * 12/1989 Ragle ..... F42B 12/385 455/127.1
4,940,245 A * 7/1990 Bittle, Jr. ..... A01M 31/00 342/386
RE33,470 E * 12/1990 Boy ..... F42B 12/385 342/386
5,157,405 A * 10/1992 Wycoff ..... F42B 12/385 342/386
6,707,346 B2 * 3/2004 Tillotson ..... G04F 5/06 331/158
6,856,250 B2 * 2/2005 Hilliard ..... G01S 13/758 102/502
7,316,202 B2 * 1/2008 Fantin ..... A01K 11/003 119/174
7,598,869 B2 * 10/2009 Kumagai ..... G07G 1/009 340/10.51
7,822,424 B2 * 10/2010 Markhovsky ..... G01S 13/74 455/456.1
7,965,188 B2 * 6/2011 Geissler ..... A01K 11/004 340/10.4

(Continued)

OTHER PUBLICATIONS

The "Loc8tor" User Guide, Copyright 2006, Available from www.Loc8tor.com.*

(Continued)

*Primary Examiner* — John Ricci
(74) *Attorney, Agent, or Firm* — Brie A. Crawford

(57) ABSTRACT

An improved electronic game tracking system is disclosed. The game tracking system uses electronic radio ranging to determine the distance and direction to a game animal to which the game tracking system is attached. Improvements to the game tracking system address disclosed sources of range determination error and remove or reduce their effects on the determination of the range between an electronic receiver which can detect the transmitter or tag and the transmitter or tag.

10 Claims, 9 Drawing Sheets

(56) References Cited

U.S. PATENT DOCUMENTS

| | | | | |
|---|---|---|---|---|
| 7,982,601 | B2 * | 7/2011 | Corrado | G06K 7/10079 340/10.1 |
| 8,952,808 | B2 | 2/2015 | Steinman et al. | |
| 8,953,581 | B1 * | 2/2015 | Charles | H04L 7/048 370/350 |
| 9,062,947 | B1 * | 6/2015 | Patel | F42B 6/04 |
| 2003/0132846 | A1 * | 7/2003 | Hilliard | A01K 11/008 340/573.2 |
| 2004/0048703 | A1 * | 3/2004 | Cyr | F42B 6/06 473/578 |
| 2005/0231362 | A1 * | 10/2005 | Pridmore, Jr. | A01M 31/002 340/539.32 |
| 2007/0042844 | A1 * | 2/2007 | Stote, III | A63B 59/00 473/564 |
| 2007/0142137 | A1 * | 6/2007 | Davenhaver | A01M 31/002 473/578 |
| 2008/0248903 | A1 * | 10/2008 | Cyr | F42B 6/04 473/575 |
| 2009/0098958 | A1 * | 4/2009 | Miner | F42B 12/387 473/570 |
| 2009/0231190 | A1 * | 9/2009 | Grumbles | G01C 21/00 342/357.57 |
| 2010/0035709 | A1 * | 2/2010 | Russell | F42B 12/385 473/570 |

OTHER PUBLICATIONS

Semtech Corporation, "Improving the Accuracy of a Crystal Oscillator," Jan. 2009, pp. 1-8, California.

* cited by examiner

ELECTRONIC GAME TRACKING SYSTEM

CROSS REFERENCE TO RELATED APPLICATIONS AND INCORPORATION BY REFERENCE

This application is a continuation-in-part of and claims priority to the previously filed U.S. Utility patent application Ser. No. 14/746,768 titled ELECTRONIC GAME TRACKING DEVICE, with an application filing date of Jun. 22, 2015, filed in the United States Patent and Trademark Office, itself a continuation of U.S. Utility patent application Ser. No. 13/374,672, also titled ELECTRONIC GAME TRACKING DEVICE, with an application filing date of Jan. 6, 2012, filed in the United States Patent and Trademark Office. Application Ser. No. 13/374,672 and Application Ser. No. 14/746,768 were both invented by the same inventive entity, and the entirety of both applications are incorporated herein by reference in their entirety to provide continuity of disclosure. A Notice of Allowance was granted on Application Ser. No. 13/374,672 on Feb. 19, 2015 and it issued as U.S. Pat. No. 9,062,947B1 on Jun. 23, 2015. While a Notice of Allowance has been granted on Application Ser. No. 14/746,768, at the time of filing this continuation-in-part application, the Ser. No. 14/746,768 application is still pending and has not issued as a patent.

This application is a CONTINUATION-IN-PART of the previously-filed applications identified above and contains new matter not necessarily supported thereby.

FIELD OF THE INVENTION

This invention relates to an electronic game tracking system, and more particularly to an electronic game tracking system, which is attached to an arrow in order to permit electronic tracking of an animal struck by an arrow after the arrow is loosed or shot from a bow, and an accompanying receiver which receives a signal from the electronic game tracking system. The electronic game tracking system provides guidance as to the distance and direction to the electronic game tracking system to allow the user to locate the animal.

BACKGROUND OF THE INVENTION

Bow hunting for deer, elk, bear, caribou, moose, turkey, fish, or other game animals is a widely enjoyed sport. Individual states set laws dictating the legality of bow hunting including the permissible time period, type of game, designated hunting areas, and other factors.

Bow hunters shoot game in much closer proximity to the game animal than shotgun or rifle hunters. Also, unlike shotgun or rifle hunting, when an animal is struck with an arrow, it almost always runs long distances. The wounded animal is not always easily trackable. Bow hunters generally track the animal by following a blood trail, using scent hounds, following the disruption in the terrain, or luck. It can be very inhumane to the animal to prolong the suffering when the hunter cannot find the body, and it is wasteful if the animal dies and is not recovered by the hunter. A system that will make tracking the wounded animal more convenient or efficient is a useful invention.

Most electronic devices which track game use radio detection and ranging methods. A signal is transmitted by and/or between a transponder or transmitter unit (generally, a "tracking device") which has been affixed to the animal, usually by way of an arrow or similar projectile, and a transponder or receiver unit (generally a "receiver," collectively a "tracking system") which indicates the direction and distance to the tracking device. The accuracy of the guidance provided by the tracking system is directly related to the measurement of various properties of the signal by the tracking system. These measurements are subject to error, which reduces the accuracy of the guidance. A system that will compensate for the error in measurement and increase the accuracy of the guidance provided by a tracking system is a useful invention.

The calculations performed by the tracking system are also subject to parameters not directly related to the transmission and receipt of the signal. Accounting for these parameters increases the accuracy of the guidance. A system that accounts for parameters not directly related to the transmission and receipt of the signal is a useful invention.

SUMMARY OF THE INVENTION

Among the many objectives of the present invention is the provision of an electronic game tracking system which expedites the process of locating a wounded animal.

Also, another objective of the present invention is the provision of an electronic game tracking system which accounts and compensates for errors in measurement.

Moreover, another objective of the present invention is the provision of an electronic game tracking system that accounts for parameters not directly related to the transmission and receipt of the signal.

These and other objectives of the invention (which other objectives become clear by consideration of the specification, claims and drawings as a whole) are met by providing an electronic game tracking system which uses radio frequency identification technology to allow a hunter to readily find a wounded animal, but is still easily transported and utilized.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
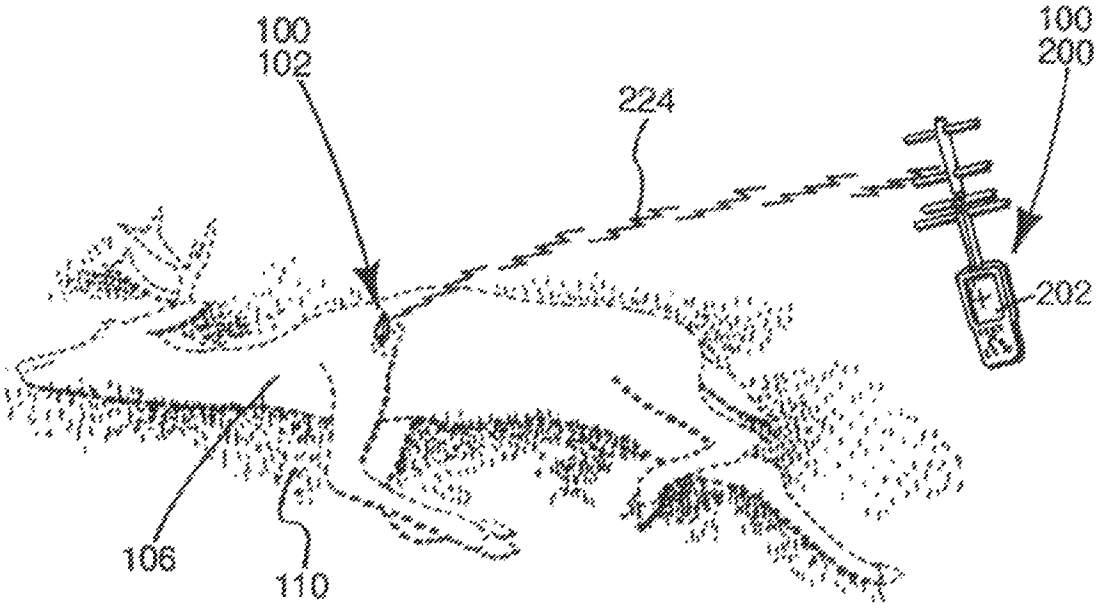
FIG. 1 depicts a top, perspective view of downed animal 106 and the sending unit 102 transmitting the signal 224 to receiving unit 200, with downed animal 106 depicted in phantom.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

The tracking system of this invention has a sending unit and a receiving unit. These units can be of any reasonable configuration: It is preferred, but not required, that they be configured as shown in U.S. Utility patent application Ser. No. 14/746,768 titled ELECTRONIC GAME TRACKING DEVICE, itself a continuation of U.S. Utility patent application Ser. No. 13/374,672, also titled ELECTRONIC GAME TRACKING DEVICE. The sending unit is attached to an arrow and has barbs that allow it to remain with a target animal even if the arrow completely traverses the body. The sending unit sends a signal which is received by the receiving unit. Thus, if the sending unit did not detach from the arrow and remain with the body, the receiving unit would not lead the hunter to the struck or down animal.

The sending unit of this tracking system is small in size and weight. Thus, the sending unit does not cause great interference with the trajectory of the arrow. The sending unit, with its housing, is preferably between 1.27 centimeters (0.5 inches) to 5.08 centimeters (2.0 inches) in length by 0.64 centimeters (0.25 inches) to 2.54 centimeters (1 inches) in width and 2.0 grams (0.0044 pounds) to 3.0 grams (0.0066 pounds) in weight. More preferably, the sending unit is between 1.91 centimeters (0.75 inches) to 3.81 centimeters (1.5 inches) in length by 1.27 centimeters (0.5 inches) to 1.91 centimeters (0.75 inches) in width and 2.25 grams (0.0050 pounds) to 2.8 grams (0.0062 pounds) in weight.

Most preferably, the sending unit is between 2.29 centimeters (0.9 inches) to 3.18 centimeters (1.25 inches) in length by 1.52 centimeters (0.6 inches) to 1.78 centimeters (0.7 inches) in width and 2.5 grams (0.0055 pounds) to 2.75 grams (0.0061 pounds) in weight.

The tracking system of this invention uses radio frequency identification technology (hereinafter "RFID") which provides great versatility and flexibility.

Due to the RFID technology, the receiving unit can read information from the sending unit even through objects. Thus, if the sending unit is lodged in the body of an animal, the receiving unit can still receive signals and track the animal. The sending unit does not have to be in the line of sight of the receiving unit for the tracking system to function.

It is preferred, but not required, that the sending and receiving units use the LoRa® modulation scheme as created by SEMTECH, INC. and embodied in chipsets made or licensed by SEMTECH, INC. It is strongly preferred, but not required, that some long-range, low-power communications protocol be used to enable communication between the sending and receiving units. If this is not done the range and/or useful tracking time of the system will be greatly reduced.

The receiving unit is also small in size so that it is easily transported and utilized by the hunter. In the preferred embodiment, the receiving unit is less than 22.86 centimeters (9 inches) in length and 15.24 centimeters (6 inches) in width.

Figure 2:
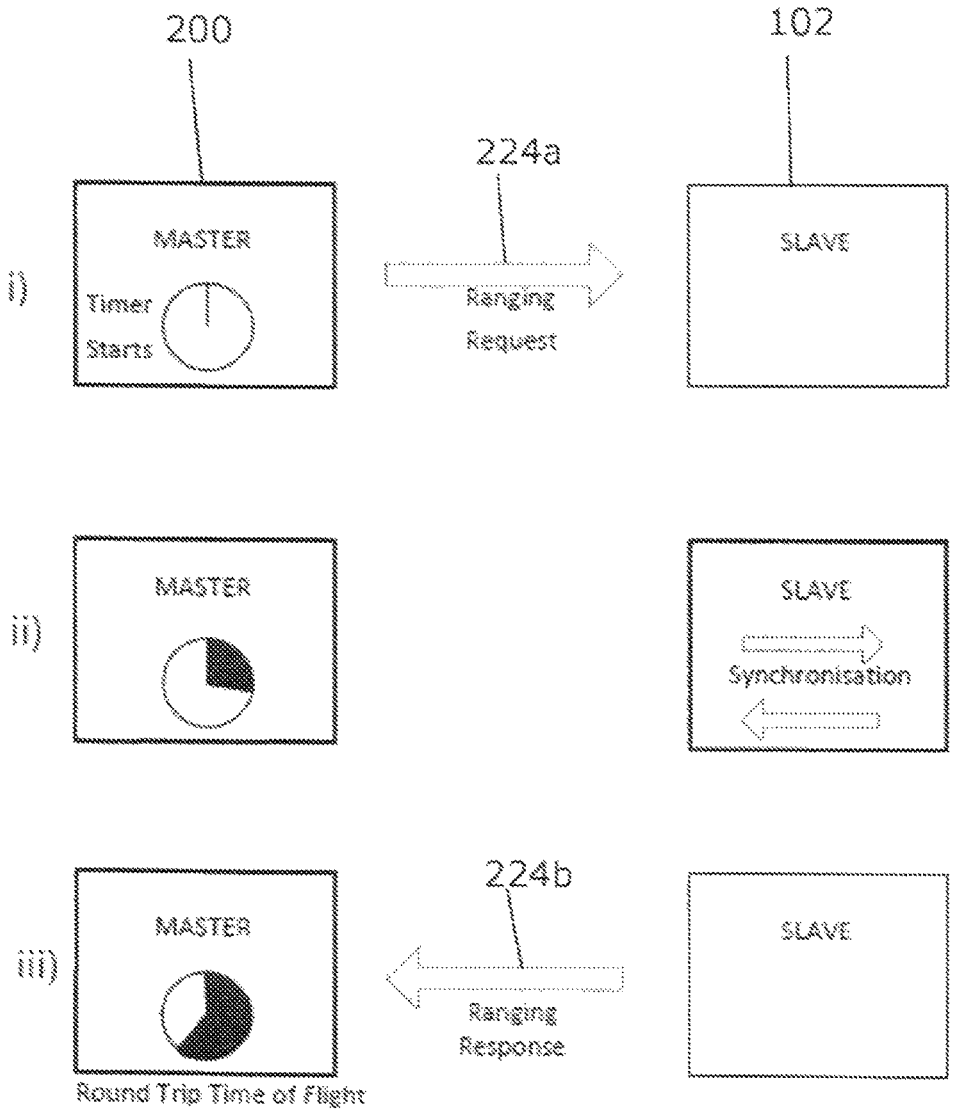
FIG. 2 depicts a flow diagram for the overall process used by the invention.

Now adding FIG. 1 and FIG. 2 to the consideration, the structure and use of tracking system 100 can be clearly seen. FIG. 1 depicts downed animal 106, which has been struck by an arrow (not shown.) Tracking system 100 has sending unit 102, which attaches itself via barbs (not shown) when downed animal 106 was struck by the arrow. Sending unit 102 is a transmitter or tag and these terms are used interchangeably throughout this disclosure. Sending unit 102 stays with downed animal 106 regardless of the amount of ground 110 traversed before downed animal 106 came to rest.

Sending unit 102 generates and receives signals 224 from receiving unit 200. Receiving unit 200 generates and receives signals 224 from sending unit 102. RFID technology is used to send and receive signals 224. Since RFID technology is used to send and receive signals 224, signals 224 can be read even if sending unit 102 is implanted in down animal 106 or has other environmental factors blocking a direct path between sending unit 102 and receiving unit 200. RFID technology allows the sending unit 102 and the receiving unit 200 to communicate.

FIG. 2 shows the process flow used by the invention. It is important to note that nothing shown in FIG. 2 is novel: the basic method of measuring the flight time of a signal to calculate the distance it travels is well-known in the art. However, it is required to follow the process to see the novel improvements to the prior art provided by the invention.

Receiving unit 200 assumes what is known as the "master" role, and sending unit 102 assumes what is known as the "slave" role. This means that sending unit 102 does not actively transmit unless responding to a transmission from receiving unit 200. This allows sending unit 102 to conserve power as it does nothing unless purposefully activated by receiving unit 200. It is strongly preferred, but not required, that the units be configured in this way. If this is not done, the useful tracking time of the system will be greatly reduced.

In step (i), receiving unit 200 sends ranging request transmission 224*a*, simultaneously starting a timer. In step (ii), sending unit 102 synchronizes itself with receiving unit 200, using a fixed process which takes a fixed amount of time known to receiving unit 200. In step (iii), sending unit 102 sends ranging response transmission 224*b*, which is received by receiving unit 200. Receiving unit 200 stops the timer upon receipt of ranging response transmission 224*b*, giving a total elapsed time measurement. Subtracting the fixed amount of synchronization time from the total elapsed time measurement gives a total time of flight. Multiplying the total time of flight divided by two (to account for the signal traveling both ways) by the speed of light gives a total distance from receiving unit 200 to sending unit 102.

Errors may be introduced into the calculation performed after step (iii) in multiple ways. Compensating for these errors comprises the novel features of the invention.

Figure 3:
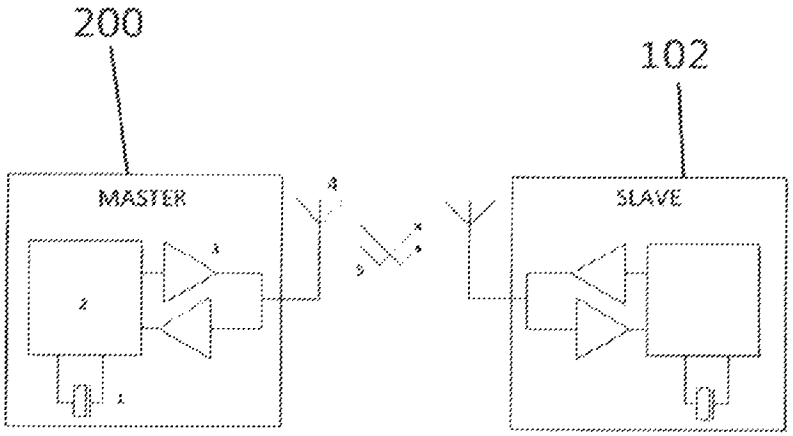
FIG. 3 depicts an abstracted schematic of the preferred embodiment of the invention indicating potential sources of error.

FIG. 3 shows the primary sources of error. The first source of error is known as crystal timing error, shown in association with crystal 1. Both receiving unit 200 and sending unit 102 have a crystal which is used to calculate time, using the well-known method of crystal frequency measurement. Every crystal has a unique frequency: the difference in frequency between the crystals in the units will create crystal timing error, which means that what receiving unit 200 calculates as the fixed synchronization time (counting oscillations of crystal 1) will be different from what sending unit 102 calculates as the fixed synchronization time.

The second source of error is circuit propagation error, shown in association with digital processing block 2 and analogue processing circuit 3. It takes some fixed time for the signal to move through these parts of both units. The amount of time can be considered device specific (individual variations in particular devices can be disregarded in most circumstances.)

The third source of error is antenna delay error, shown in association with antenna 4. Both units will have some delay associated with both the radiation and the receipt of the signal by their respective antennas. Furthermore, this delay may not be uniform in that the orientation of the antennas and other factors may cause it to vary depending on the direction of a radiated or received signal.

The fourth source of error is signal multipathing, shown in association with abstracted signal paths 5. Signal 224 (see FIG. 1) will travel in a straight line between the units if there is nothing to slow or reflect the radio waves. However, in practice this is rarely the case: the environment will be filled with trees, rocks, and/or buildings and other obstacles which will reflect and/or diffract signal 224. The radio waves emitted by sending unit 102 will therefore travel through different paths, some of which will not be straight line-of-sight paths. Because of this, signal 224 will usually not arrive as a single tight burst of radio waves, but as multiple intermittent groups of radio waves. This will make it more difficult for receiving unit 200 to determine the "true" time of flight and thus the range to sending unit 102. The error this process introduces is referred to as multipath error.

The invention addresses crystal timing error and circuit-propagation error. This allows its novel improvements to be considered in terms of idealized line of sight conditions. While the invention does not address antenna error or multipath error, it could be used in combination with methods and/or devices which address these sources of error. Such a combination would still benefit from the novel features of the invention.

Figure 4:
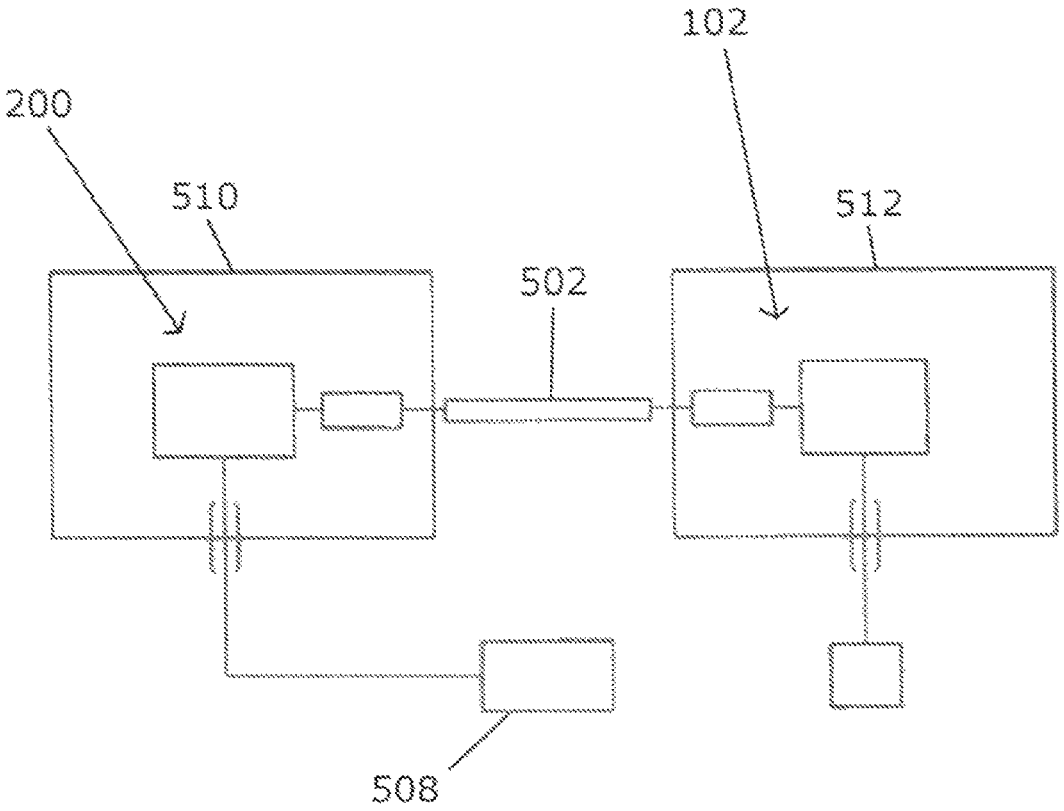
FIG. 4 depicts an abstracted action schematic diagram for calculating a circuit-propagation error correction value.

FIG. 4 shows the application of the first part of the invention: measuring circuit-propagation error and compensating for it. Sending unit 102 (shown here as multiple abstracted electronic circuits) and receiving unit 200 (shown here as multiple abstracted electronic circuits) are connected by a signal-carrying cable 502 of a known length. Receiving unit 200 is connected to controller 508. Controller 508 can be a general purpose computer running appropriate software or a special-purpose device: it is required only that controller 508 be able to receive time-of-flight data from receiving unit 200 and to set a compensating factor in receiving unit 200 such that receiving unit 200 will be able to use the compensating factor in future range calculations.

It is preferred, but not required, that receiving unit 200 be surrounded by first RF shield 510 and that sending unit 102 be surrounded by second RF shield 512, with both RF shields being opaque to the radio frequencies used by the sending and receiving units (wherein RF stands for "radio frequency.) If this is not done, even absent installed antennas, RF signals may be transmitted and received by the units and reduce the accuracy of the measurement to be taken.

Receiving unit 200 sends a ranging request signal to sending unit 102 through signal-carrying cable 502. Sending unit 102 then synchronizes and sends a ranging response signal to receiving unit 200 through signal-carrying cable 502. Receiving unit 200 calculates time-of-flight and provides the calculated time-of-flight to controller 508. Because the speed at which the signal propagates through signal-carrying cable 502 can be predetermined with accuracy due to its fixed physical properties, a circuit-propagation error correction factor can be determined by subtracting the known propagation time through signal-carrying cable 502 from the calculated time-of-flight. The circuit-propagation correction factor can be calculated by controller 508 and then stored on receiving unit 200. In use, receiving unit 200 can use the circuit-propagation correction factor to more accurately determine the actual time-of-flight of the signal.

It is strongly preferred, but not required, to repeat this process multiple times and use an average measurement to account for individual variation in any particular signal round trip. If this is done, controller 508 should calculate an average circuit-propagation correction factor over all measurements and store it in receiving unit 200.

It is preferred, but not required, to perform this process in an environment similar to that in which the system will be used, especially with regard to ambient temperature, as the temperature of the system can affect the conductivity of its components. It is optional to perform this process in a variety of ambient temperatures and store individual circuit-propagation correction factors for each ambient temperature. The user of the system may manually set the ambient temperature at the time of use or the system may detect the ambient temperature and select the most appropriate stored circuit-propagation correction factor for that temperature.

It is optional to perform the process described in FIG. 4 at the time of manufacture or assembly of the system, and permanently store the error-correction values in the receiving unit. It is optional to calculate an average error-correction value for a reasonable number of comparable devices and use that average error-correction value for every device manufactured which contains similar components.

Figures 5A, 5B:
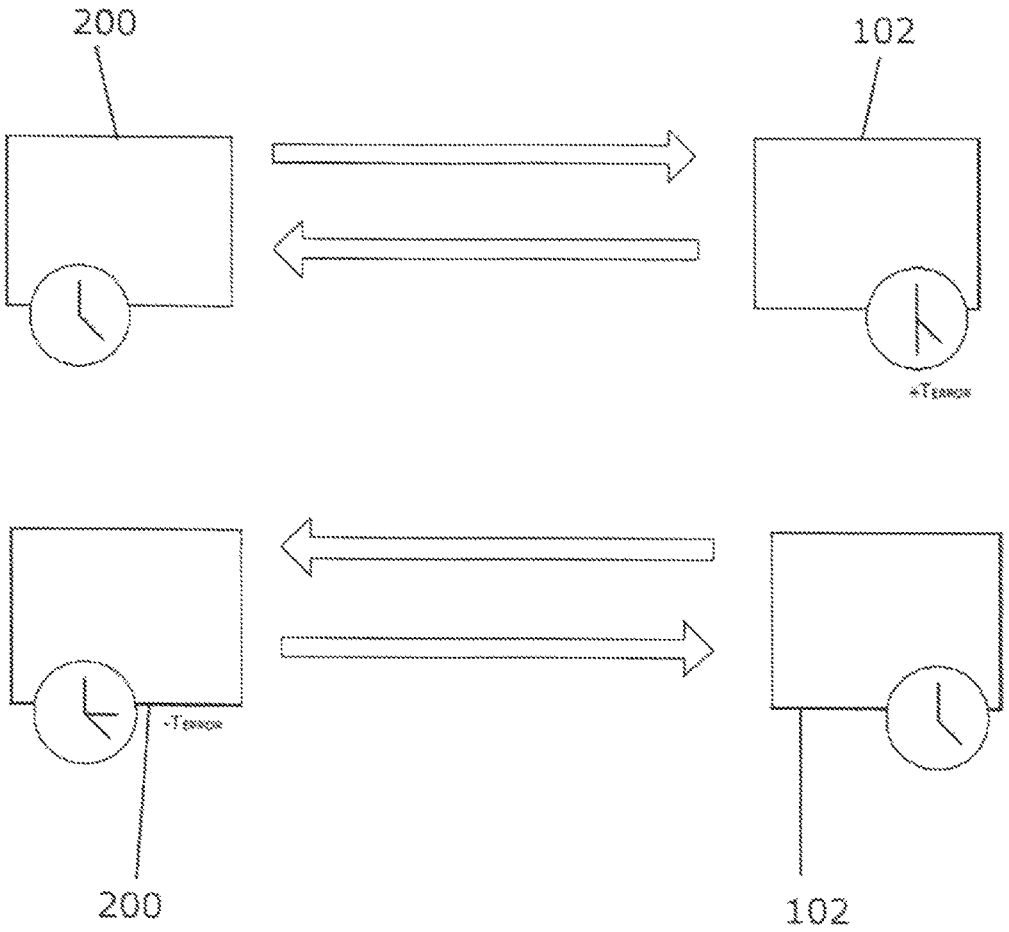
FIGS. 5*a* and 5*b* depict an abstracted action schematic for calculating a crystal timing error correction value.

FIGS. 5*a* and 5*b* shows the application of the second part of the invention: measuring crystal timing error and compensating for it. Although not shown, a controller such as controller 508 (see FIG. 4) can be used for this process. Although not shown, this process can be performed with either actual RF sending and receiving antennas in place or by using a cable as in FIG. 4. In FIG. 5*a*, receiving unit 200 sends a ranging request signal to sending unit 102 and sending unit 102 sends a ranging response signal to receiving unit 200 resulting in a first measured time of flight or FMTOF. The crystal timing error introduced by the difference in crystal frequencies in the two units is characterized as $+T_{error}$. In FIG. 5*b*, the same operation is performed, but the roles of the units are reversed, with sending unit 102 sending the ranging request signal and receiving unit 102 sending the ranging response signal resulting in a second measured time of flight or SMTOF. This introduces the same crystal timing error, but with the sign reversed (since the error is introduced by the difference between the crystal frequencies in the opposite direction.) This crystal timing error is characterized as $-T_{error}$.

Thus, the true time of flight or TTOF (disregarding other sources of error) in the first operation is:

$$TTOF=FMTOF-(+T_{error})$$

And in the second the true time of flight is:

$$TTOF=SMTOF-(-T_{error})$$

By simple arithmetic:

$$TTOF+TTOF=FMTOF-(+T_{error})+SMTOF-(-T_{error})$$

$$2(TTOF)=FMTOF+SMTOF$$

$$TTOF=(FMTOF+SMTOF)/2$$

And therefore the TTOF can be calculated simply by averaging the FMTOF and the SMTOF. Once the TTOF is known, a crystal timing error correction parameter can be determined and stored by the receiving unit. The crystal timing error correction parameter can then be applied to all time-of-flight measurements performed by the system in actual field use.

While the reversal of roles and averaging of FMTOF and SMTOF is the simplest and most efficient means of correcting for crystal timing error, this requires a great deal more transmission by the sending unit, which decreases its useful tracking time due to increased power consumption. It also requires that the sending unit be able to measure time of flight as opposed to simply sending a ranging response signal upon request, which in turn requires that the sending unit have more components and/or more sophisticated components. In a second preferred embodiment of the system, a Frequency Error Indicator, which is part of the LoRa® chip specification provided by SEMTECH, INC., can be used to calculate a crystal timing error correction factor. This is possible because the same crystal is used to calculate elapsed time for the time-of-flight calculation and the radio frequency carrier frequency of the system. The Frequency Error Indicator would be a component of receiving unit 200.

The Frequency Error Indicator can measure the received frequency of the ranging response signal and compare it to the anticipated carrier frequency of the ranging response signal. It can then calculate the crystal timing error introduced by the difference between the sending unit's crystal's actual natural frequency and the manufacturer's specified frequency.

For instance, if the specified frequency of the crystal in the sending unit is 1 GHz, and it is used to create what should be a 1 GHz signal, the difference in frequency will be directly related to the difference between the actual natural frequency and the specified frequency. A ranging response signal which is received by the receiving unit at a frequency of 1.05 GHz indicates that the sending unit's crystal has an actual natural frequency of 1.05 GHz, or 5% higher than the specified frequency.

This error is relative, because the crystal in the receiving unit is used to calculate the measured frequency of the received ranging response signal. Thus, if the receiving unit calculates that the frequency of the received ranging response signal is 5% higher than it should be, it knows to apply a crystal timing error correction factor of 5% to the calculation of true-time-of-flight. This will be correct no matter what the "true" natural frequencies of either crystal may be.

It is optional to include multiple packets of signals in the ranging request signal and the ranging response signal, each of the packets having a different specified frequency or range of frequencies. If this is done, the difference between the specified frequency of each packet and the measured frequency of each packet can be used to form a distribution of frequency variation. Experimentation with any given configuration of components can provide a curve which can be used to apply a weighted average of this distribution and improve the accuracy of the crystal timing error correction factor.

Figure 6:
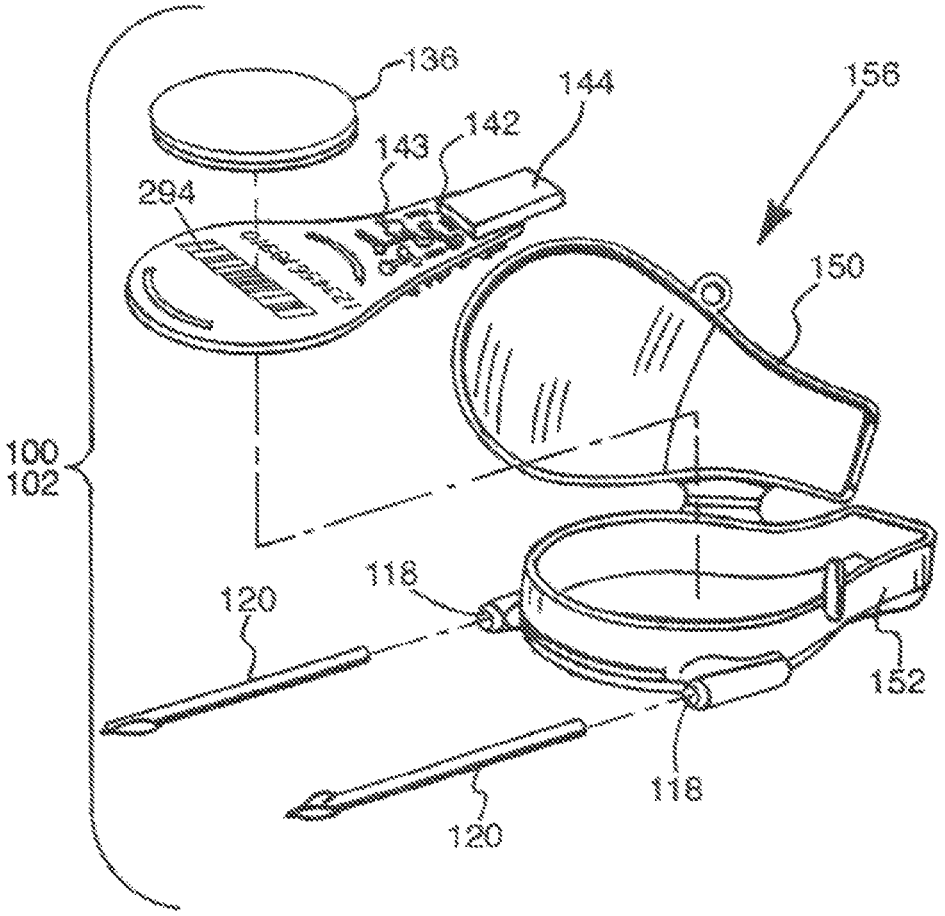
FIG. 6 depicts an exploded perspective view of the sending unit and its components.

FIG. 6 shows the components of sending unit 102 of tracking system 100. Housing 156 comprises lid 150 and base 152: when closed, housing 156 surrounds circuit board 142. Circuit board 142 fits inside housing 156 and draws power from battery 136. Circuit board 142 includes antenna 144 and controller 143. Circuit board 142 is also marked with unique tag ID 294. Unique tag ID 294, as shown, includes a bar code and a human-readable number. Controller 143 is electronically encoded with unique tag ID 294. Base 152 has receivers 118 which receive barbs 120.

Figure 7:
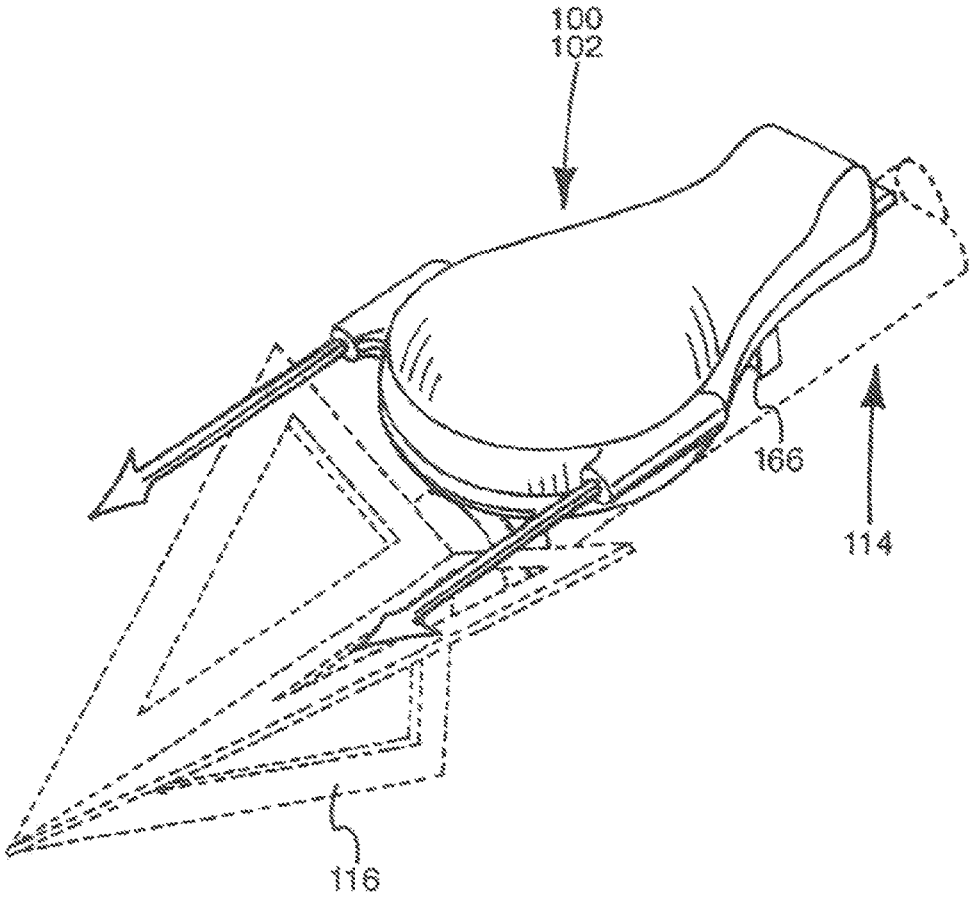
FIG. 7 depicts a perspective view of the sending unit attached to an arrow ready for use.

Although it is not visible in this Figure, lid 150 also includes releasable securing component 166 (see FIG. 7.)

FIG. 7 shows the sending unit in use. Sending unit 102 of tracking system 100 is attached to arrow 114 via releasable securing component 166. Releasable securing component 166 can be a snap-fit connector, a friction-fit connector, or any other reasonable connector or means of connecting sending unit 102 to arrow 114. When arrow 114 strikes a downed animal (see FIG. 1) arrowhead 116 penetrates the downed animal followed by the barbs, which secure sending unit 102 to the downed animal as shown in FIG. 1.

Figure 8:
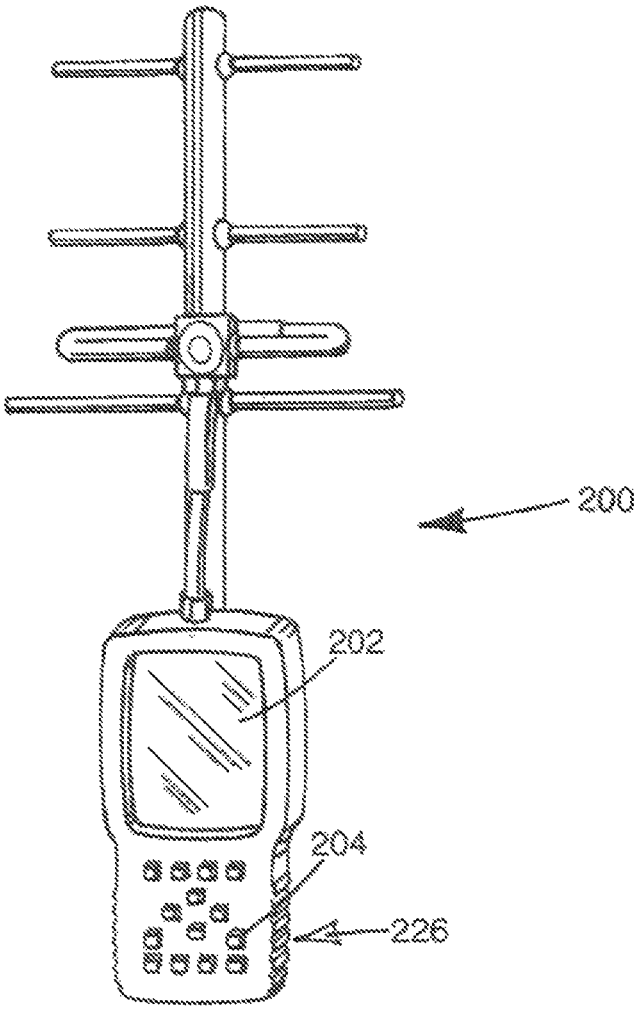
FIG. 8 depicts a perspective view of the receiving unit.

FIG. 8 shows receiving unit 200. Hand unit 226 includes screen 202 for displaying tracking information and controls 204 for controlling the tracking system.

Figure 9:
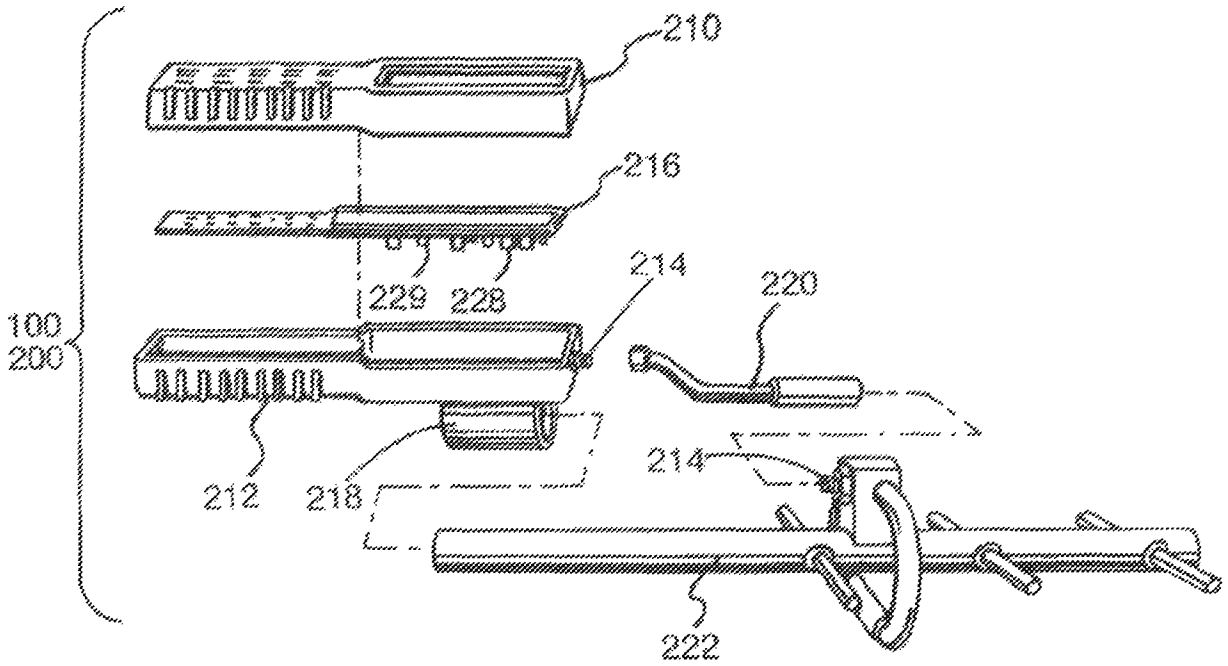
FIG. 9 depicts a side exploded perspective view of the receiving unit and its components.

FIG. 9 shows the components of receiving unit 200 of tracking system 100. Upper cover 210 and lower cover 212 (which combine to enclose hand unit 226, see FIG. 8) surround receiver circuit board 216. Receiver circuit board 216 is attached and electronically connected to receiver controller 229 and receiver battery 228, with receiver battery 228 providing power to the receiving unit including receiver controller 229. Lower cover 212 includes antenna cradle 218 which physically receives antenna 222 and secures it to receiving unit 200. Circuit board 216 is connected to coaxial cable 220 via threaded connector 214, which in turn connects to antenna 222 via another threaded connector 214, allowing receiver controller 229 to send and receive signals via antenna 222.

This application—taken as a whole with the abstract, specification, claims, and drawings—provides sufficient information for a person having ordinary skill in the art to practice the invention disclosed and claimed herein.

Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. An electronic game tracking system comprising:

a) the electronic game tracking system having a sending unit and a receiving unit;

b) the sending unit including a housing;

c) the sending unit comprising a releasable securing component which is attachable to an arrow, wherein the sending unit can be secured to an arrow shaft of the arrow;

d) the electronic game tracking system using radio frequency identification technology [RFID], including a RFID signal, to facilitate tracking of a game animal;

e) the sending unit comprising a tag circuit board, a tag antenna, a tag battery, and a tag controller;

f) the receiving unit comprising a receiving unit antenna, a receiving unit battery, and a receiving unit controller;

g) the tag circuit board emitting the RFID signal through the tag antenna;

h) the receiving unit receiving the RFID signal through the receiving unit antenna; and, i) the receiving unit having a crystal timing error correction storage, the crystal timing error correction storage storing a crystal timing error correction value, the crystal timing error correction value calculated by determining an actual frequency of the RFID signal and comparing it to a specified frequency of the RFID signal.

2. The electronic game tracking system of claim 1 wherein:

a) the RFID signal comprises at least two frequency packets, each of the at least two frequency packets having a specified packet frequency and an actual packet frequency, and the crystal timing error correction value is calculated by using a weighted average of a distribution of the specified packet frequencies versus a distribution of the actual packet frequencies.

3. An electronic game tracking system comprising:

a) the electronic game tracking system having a sending unit and a receiving unit;

b) the sending unit including a housing;

c) the sending unit comprising a releasable securing component which is attachable to an arrow, wherein the sending unit can be secured to an arrow shaft of the arrow;

d) the electronic game tracking system using radio frequency identification technology [RFID], including a RFID signal, to facilitate tracking of a game animal;

e) the sending unit comprising a tag circuit board, a tag antenna, a tag battery, and a tag controller;

f) the receiving unit comprising a receiving unit antenna, a receiving unit battery, and a receiving unit controller;

g) the tag circuit board emitting the RFID signal through the tag antenna;

h) the receiving unit receiving the RFID signal through the receiving unit antenna;

i) the receiving unit having a first circuit-propagation error correction storage, the first circuit-propagation error correction storage storing a first circuit-propagation error correction value, the first circuit-propagation error correction value calculated by measuring a first circuit-propagation delay inherent to a plurality of electronic circuits in the receiving unit controller; and, j) the receiving unit having a crystal timing error correction storage, the crystal timing error correction storage storing a crystal timing error correction value, the crystal timing error correction value calculated by determining an actual frequency of the RFID signal and comparing it to a specified frequency of the RFID signal.

4. The electronic game tracking system of claim 3 wherein:

a) the RFID signal comprises at least two frequency packets, each of the at least two frequency packets having a specified packet frequency and an actual packet frequency, and the crystal timing error correction value is calculated by using a weighted average of a distribution of the specified packet frequencies versus a distribution of the actual packet frequencies.

5. The electronic game tracking system of claim 4 further comprising:

a) the receiving unit having a second circuit-propagation error correction storage, the second circuit-propagation error correction storage storing a second circuit-propagation error correction value, the second circuit-propagation error correction value calculated by measuring a second circuit-propagation delay inherent to a plurality of electronic circuits in the tag circuit board and the tag controller.

6. The electronic game tracking system of claim 5 wherein:

a) the first circuit-propagation error correction value is permanently stored in the first circuit-propagation error correction storage; and, b) the second circuit-propagation error correction value is permanently stored in the second circuit-propagation error correction storage.

7. The electronic game tracking system of claim 4 wherein:

a) the first circuit-propagation error correction value is permanently stored in the first circuit-propagation error correction storage.

8. The electronic game tracking system of claim 3 further comprising:

a) the receiving unit having a second circuit-propagation error correction storage, the second circuit-propagation error correction storage storing a second circuit-propagation error correction value, the second circuit-propagation error correction value calculated by measuring a second circuit-propagation delay inherent to a plurality of electronic circuits in the tag circuit board and the tag controller.

9. The electronic game tracking system of claim 8 wherein:

a) the first circuit-propagation error correction value is permanently stored in the first circuit-propagation error correction storage; and, b) the second circuit-propagation error correction value is permanently stored in the second circuit-propagation error correction storage.

10. The electronic game tracking system of claim 3 wherein:

a) the first circuit-propagation error correction value is permanently stored in the first circuit-propagation error correction storage.

* * * * *